US007330091B2

(12) United States Patent
Peng et al.

(10) Patent No.: US 7,330,091 B2
(45) Date of Patent: Feb. 12, 2008

(54) ELECTRONIC TYPE PROTECTIVE RELAY

(75) Inventors: Seng-Wen Peng, Hsinchu County (TW); Fong-Jhou Chen, Jhonghe (TW)

(73) Assignee: Teco Electric & Machinery Co., Ltd., Taipei (TW)

( * ) Notice: Subject to any disclaimer, the term of this patent is extended or adjusted under 35 U.S.C. 154(b) by 256 days.

(21) Appl. No.: 11/313,818

(22) Filed: Dec. 22, 2005

(65) Prior Publication Data

US 2006/0158813 A1 Jul. 20, 2006

(30) Foreign Application Priority Data

Jan. 14, 2005 (TW) ..... 94200780 U

(51) Int. Cl.
*H01H 75/00* (2006.01)

(52) U.S. Cl. ..... 335/6; 335/21; 335/26; 335/27; 335/78; 335/79; 335/85; 335/179; 335/180; 335/181; 361/42

(58) Field of Classification Search ..... 335/6, 335/17, 21–27, 78, 79, 84, 85, 179–181
See application file for complete search history.

(56) References Cited

U.S. PATENT DOCUMENTS 5,332,986 A 7/1994 Wieloch et al.
5,994,987 A 11/1999 Passow et al.
6,025,766 A * 2/2000 Passow ..... 335/78

* cited by examiner

*Primary Examiner*—Ramon M. Barrera
(74) *Attorney, Agent, or Firm*—Rosenberg, Klein & Lee

(57) ABSTRACT

An electronic type protective relay integrates the mechanical structure into a single operation rod to protect electric machinery. The electronic type protective relay includes an insulating shell, a tripping rod, a magnetic-force device and an operation device. The tripping rod is pivoted in the inner part of the insulating shell and conducts two pairs of connection pins. The tripping rod includes a control magnetic core. The magnetic-force device includes a tripping electromagnet, a reset electromagnet, and a permanent magnet installed between the tripping electromagnet and the reset electromagnet. The operation device includes an auxiliary rod located on one side of the tripping rod, an operation rod installed between the tripping rod and the auxiliary rod and protruding beyond the insulating shell. The operation rod can be located at four locations and in cooperation with the auxiliary rod to stop or reset.

24 Claims, 10 Drawing Sheets

ELECTRONIC TYPE PROTECTIVE RELAY

BACKGROUND OF THE INVENTION

1. Field of the Invention

The present invention relates to an electronic type protective relay. In particular, the mechanical structure of the electronic type protective relay collaborates with the electronic device in the electronic type protective relay. Therefore, the mechanical structure takes off the contacting terminal so that the circuit is open during overloading, and then the mechanical structure is reset to recover the circuit from an open-circuit.

2. Description of the Related Art

The relay has been developed for a long period of time and adapted in different industrial products. The electromagnetic relay is widely used in circuit and is a common control device in the electric machinery. The electronic type protective relay, such as a motor overload relay, is usually used for automatically tripping the circuit in mechanical equipment so as to protect mechanical equipment in case of circuit overload. FIG. 1 is a schematic diagram of an application of an electronic type protective relay according to the prior art. The electronic type protective relay 91 is installed between an electronic-magnetic contacting device 92 and a load 93 (such as a motor). The electronic type protective relay 91 comprises an electronic sensing device to detect an overload, and a set of mechanical structure that collaborates with the electronic sensing device to automatically trip the contacting terminal so as to open the circuit. Furthermore, the electronic type protective relay 91 provides an auto reset function after a default period passes. There is also a manual reset button on the panel for providing a manual reset function. The electronic-magnetic contacting device 92 is used for cutting off or conducting power between the frequency converter and the motor. When power is directly connected to the motor without passing through the frequency converter, the electronic-magnetic contacting device 92 is used for cutting off or conducting the direct power connection between the power source and the motor. Currently, an electronic type protective relay usually comprises a manual stop button and a reset button on the panel to fulfill the requirements of the circuit. The manual stop button is pressed by the operator to stop the operation of the motor. The reset button provides a manual reset function and an auto reset function. The manual stop button and the reset button operate in cooperation with permanent magnets, coils, magnetic core elements and a tripping rod to provide the above functions.

However, the above electronic type protective relay adopts a stop operation and a reset operation that are operated separately and has two buttons. The assembly of the mechanical structure is complex and time-consuming. The number and cost of the components are therefore increased, and the assembly cost is also raised. On the other hand, the two buttons of the prior art electronic type protective relay only provides three functions—manual stop, manual reset and auto reset. The operation rod cannot perform the auto reset and the stop function simultaneously. In addition, the design requirement of magnetic path is much more for accomplishing stop, manual reset and auto reset functions instantly, so that the designing and manufacturing are more complex. After developing for a long period time, there are some conventional products.

For example, the U.S. Pat. No. 5,332,986 is published on Jul. 26, 1994 and disclosed a relay structure. The relay structure includes two buttons that are used for test and reset individually, and a steel follower is a required element for accomplishing the functions. When an actuator bar moves to the tripped position, the steel follower slides against a yoke member and has one end abutting the steel portion of the actuator bar at its first end. Then, the steel follower is magnetically attracted to the actuator bar and forms a close electromagnetic loop. When an overload condition ceases to exist and no current flows through coil, or when the reset button is depressed, the magnetic attraction between follower and the first end of the actuator bar is sufficient so that when the follower is moved downward the first end of the actuator bar moves with it. Thus, an electromagnetic loop of reset condition is formed and the actuator bar abuts the yoke member again at this time. Therefore, no matter in a tripped position or a rest position, the prior art both requires a close electromagnetic loop.

Also, the U.S. Pat. No. 5,994,987 is published on Nov. 30, 1999 and disclosed a relay structure. The relay structure includes a housing and a spring latching finger. The spring latching finger has a fixed end. By abutting the fixed end against the housing, the spring latching finger is fixed to the housing. The spring latching finger has an upturned end that is adapted to embrace and latch against latch surfaces to lock a latch lever for a manual operation function. Although this prior art does not need a complex electromagnetic loop, however when operating with a manual operator, the spring latching finger either latches against the latch surfaces for a manual condition or is received in a detent surface for an auto condition. Unless turning an additional stop button, other function cannot be achieved. Furthermore, this prior art needs numerous elements so that the mechanism design is more complex.

The prior art electronic type protective relays are difficult in fabrication and inconvenient in application, as mentioned previously. They cannot perform the auto reset and the stop function simultaneously, and the manual reset and the stop function simultaneously by utilizing a simple magnetic loop. It is therefore very important to provide a new electronic type protective relay to overcome the above-mentioned drawbacks.

SUMMARY OF THE INVENTION

One particular aspect of the present invention is to provide an electronic type protective relay. The present invention integrates the mechanical structure into an operation rod to reduce the number of components and simplify the assembling procedure. The operation rod achieves the functions, comprising a manual reset and stop function, a manual reset and non-stop function (the b connection cannot be opened manually), an auto reset and non-stop function (the b connection cannot be opened manually), and an auto reset and stop function. Since the four functions are integrated into the operation rod, the panel of the present invention electronic type protective relay is neat.

The electronic type protective relay comprises an insulating shell, a braking spring, a tripping rod, a magnetic-force device and an operation device. The insulating shell comprises a pair of normally open (NO) connection pins and a pair of normally closed (NC) connection pins. The tripping rod is elastically pivoted in the inner part of the insulating shell and selectively conducts the two pairs of connection pins. The tripping rod comprises a control magnetic core installed at the bottom of the tripping rod, and a braking part installed on one side of the tripping rod for receiving one end of the braking spring. The magnetic-force device comprises a tripping electromagnet installed at one end of the control magnetic core, a reset electromagnet installed at another end of the control magnetic core, and a permanent magnet installed between the tripping electromagnet and the reset electromagnet. The operation device comprises an auxiliary rod installed in the insulating shell and located on one side of the tripping rod, an operation rod installed between the tripping rod and the auxiliary rod and protruding beyond the insulating shell, and a pair of elastic elements for individually providing the spring force of the operation rod and the auxiliary rod. Moreover, the operation rod is rotatably installed at four locations and in cooperation with the auxiliary rod for stopping or resetting the circuit of the connection pins.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
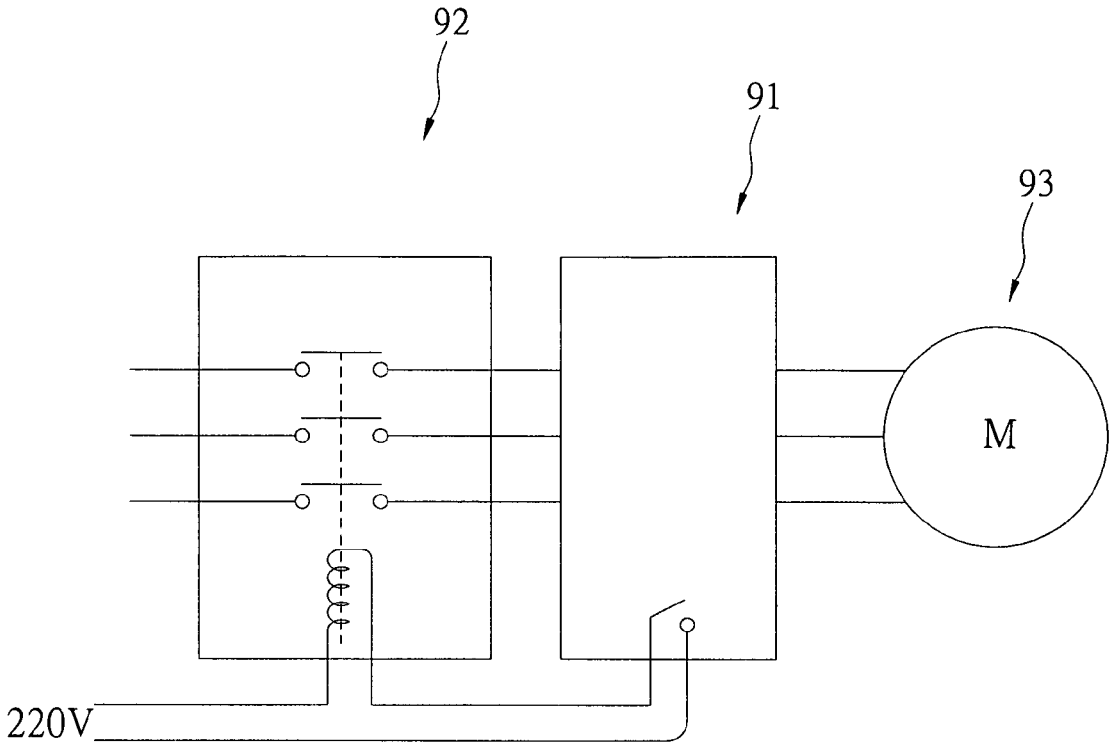
FIG 1 RELATED ART
FIG. 1 is a schematic diagram of an application of an electronic type protective relay according to the related art.
Figure 2:
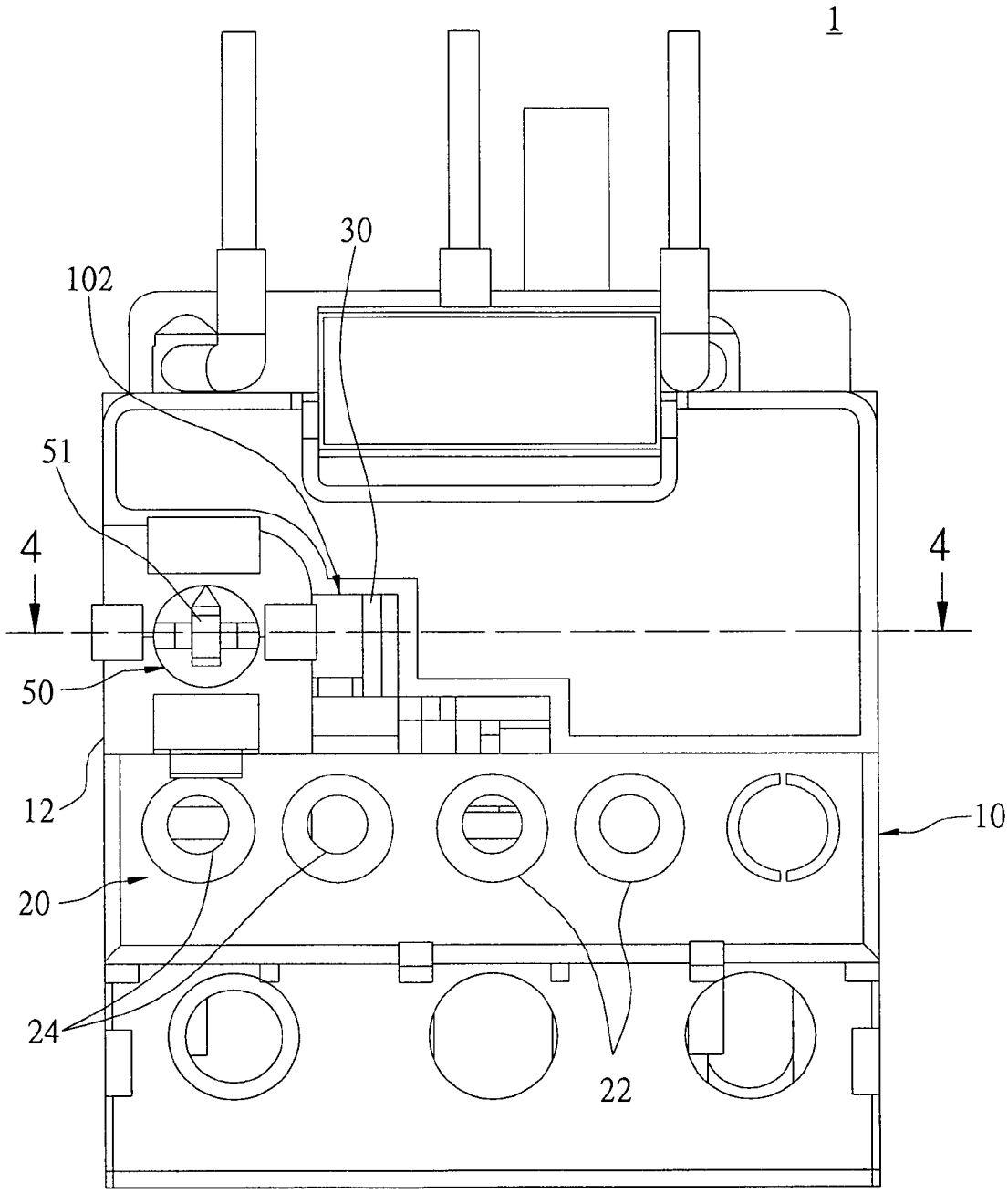
FIG. 2 is a top view of the appearance of an electronic type protective relay according to the present invention.
Figure 4:
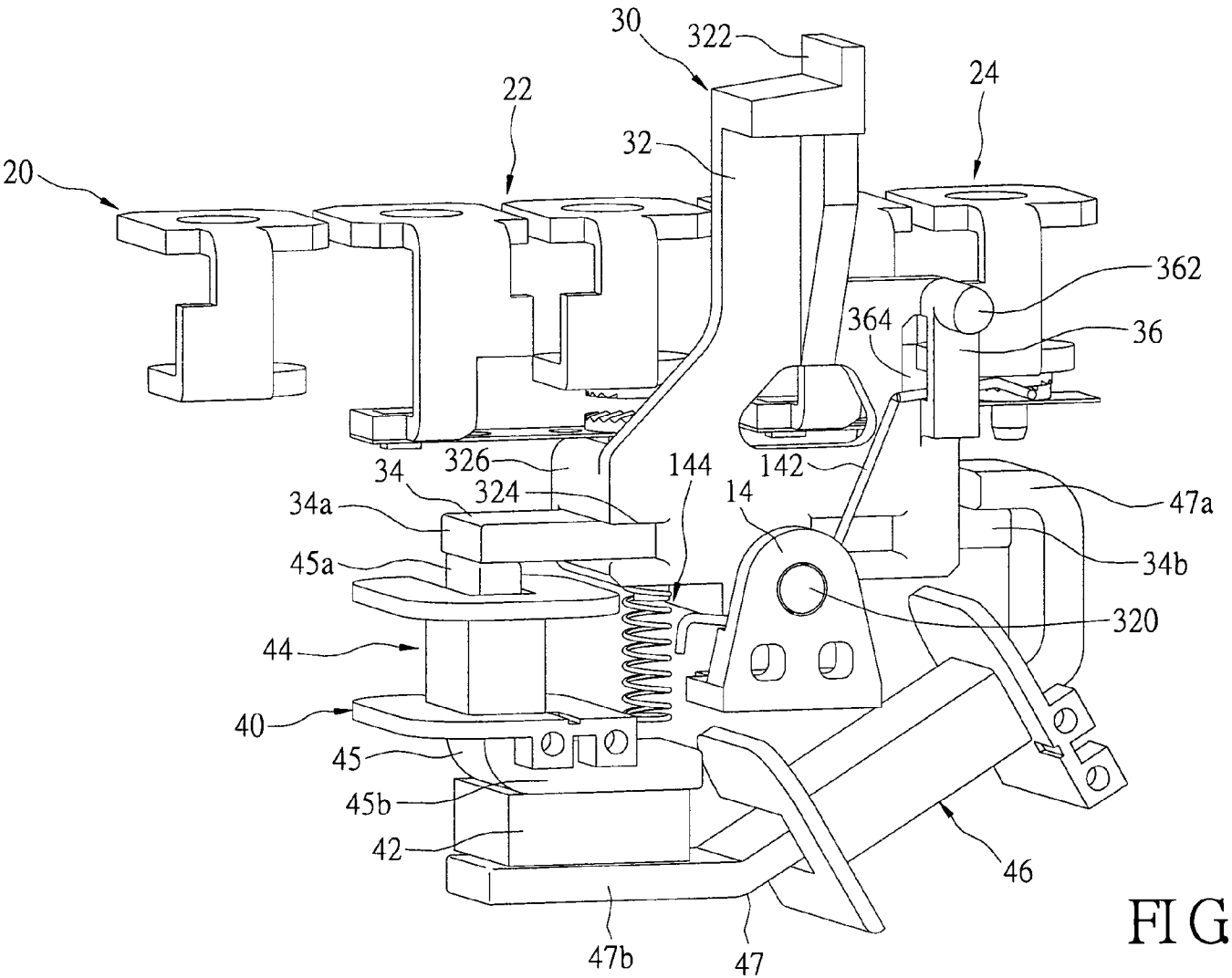
FIG. 4 is a perspective view of the inner mechanical structure of the electronic type protective relay of the present invention that is cut along the section of 4-4 in FIG. 2 with the insulating shell removed.

Please refer to FIG. 2, which shows a top view of the appearance of an electronic type protective relay according to the present invention. The electronic type protective relay 1 of the present invention comprises an insulating shell 10, a plurality of connection pins 20, an tripping rod 30 installed in the inner part of the electronic type protective relay 1, a magnetic-force device 40 installed in the inner part of the electronic type protective relay 1 (as shown in FIG. 4), and an operation rod 50. The insulating shell 10 also comprises a viewing window 102 for checking the status of the tripping rod 30 and an operation part 12 protruding outwardly for receiving the operation rod 50. The operation rod 50 protrudes beyond the insulating shell 10. The connection pins 20 comprise a pair of normally open (NO) connection pins 22 (also known as a connection pin), and a pair of normally closed (NC) connection pins 24 (also known as b connection pin). Both are electrically connected to an electronic-magnetic contacting device.

From the view of the appearance of the electronic type protective relay 1 of the present invention, the operation interface is very neat and simple. All of the functions are integrated into the operation rod 50. Please refer to FIG. 3, which shows a schematic diagram of an operation status of the operation rod of the present invention. When the operation rod 50 is pressed downward, the operation rod 50 can be rotated in the operation part 12. By pressing downward and rotating the operation rod 50 to four locations and cooperating with the tripping rod 30 and the magnetic-force device 40, the electronic type protective relay 1 achieves four control functions. The four control functions are represented by M status 50*a*, M-O status 50*b*, A status 50*c*, and A-O status 50*d*. The M status 50*a* represents a manual reset and non-stop function. This means the normally closed (NC) connection pins 24 cannot be opened manually to make the electronic type protective relay 1 open. The M-O status 50*b* represents a manual reset and stop function, the A status 50*c* represents an auto reset and non-stop function, and the A-O status 50*d* represents an auto reset and stop function. A more detailed operation for the electronic type protective relay 1 is described below.

Figure 5:
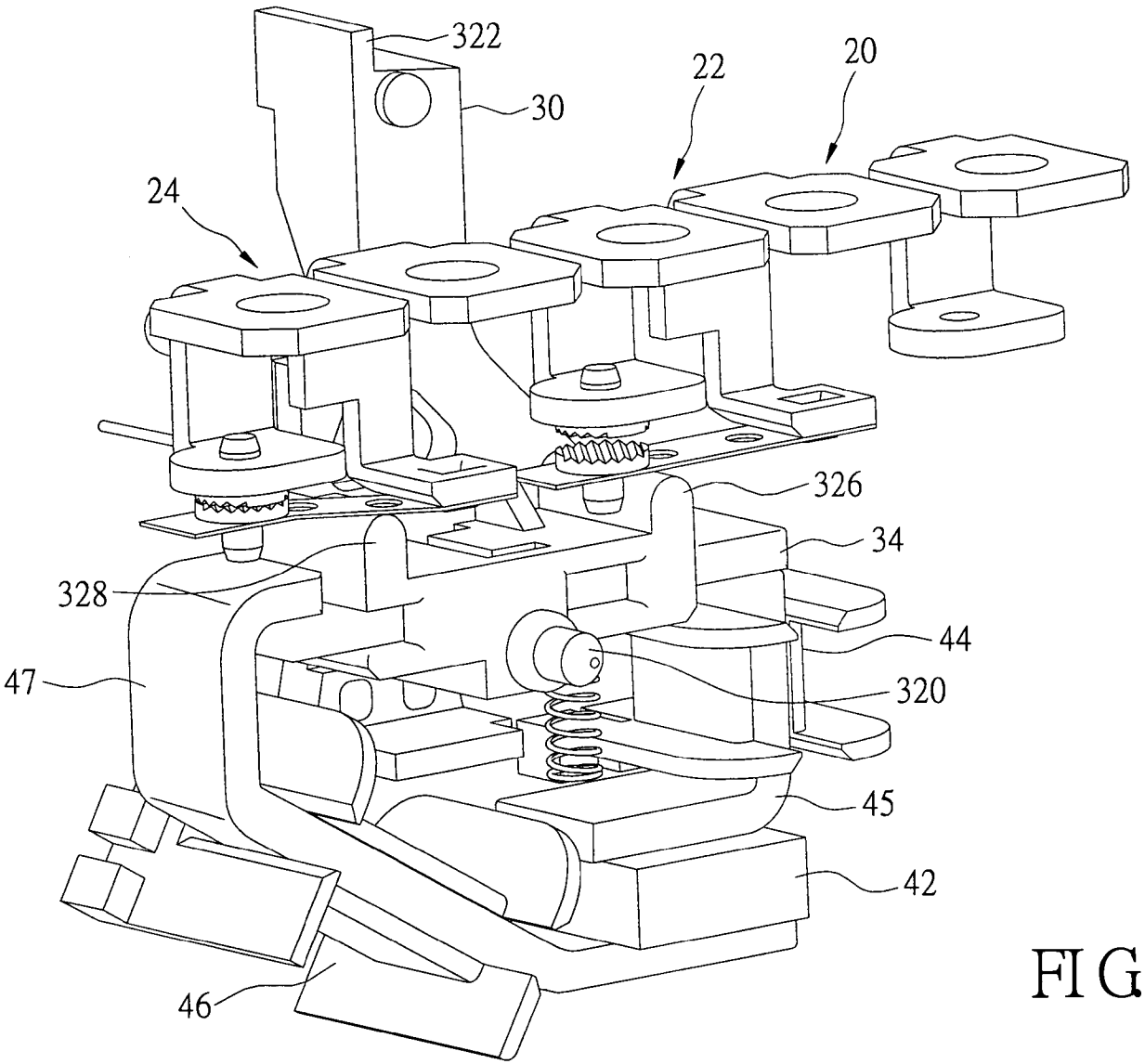
FIG. 5 is a perspective view of another angle of the inner mechanical structure of the electronic type protective relay of the present invention that is cut along the section of 4-4 in FIG. 2 with the insulating shell removed.

Please refer to FIGS. 4 and 5, which show perspective views on two different view angles of the inner mechanical structure of the electronic type protective relay of the present invention that is cut along the section of 4-4 in FIG. 2 with the insulating shell removed. In the insulating shell 10 there is a pivoting base 14. A braking spring 142 pivots on the pivoting base 14. The present invention electronic type protective relay 1 further comprises a tripping spring 144. The tripping rod 30 is made of an insulating material, and comprises a body part 32 that has a shape similar to that of a triangle and a control magnetic core 34. At least a pivoting rod 320 protrudes from the bottom of the body part 32 for pivoting with the pivoting base 14. The body part 32 further comprises an indicating flake 322 formed at the top of the body part 32 and located below the viewing window 102, a receiving slot 324 formed at the bottom of the body part 32 for receiving the control magnetic core 34, and a pair of pushing-top blocks 326, 328 that protrude upward. The pushing-top blocks 326 and 328 can selectively conduct the two pairs of connection pins 22 and 24. On one side of the body part 32 there is a braking part 36. The braking part 36 further comprises a braking column 362 located on the top of the braking part 36, and a braking slot 364 formed in the inner side of the braking part 36. The braking spring 142 extends into the braking slot 364. The operation rod 50 can selectively contact and push the braking column 362. The tripping spring 144 can selectively push the bottom of the tripping rod 30.

The magnetic-force device 40 comprises a permanent magnet 42, a tripping electromagnet 44 having a tripping magnetic core 45, and a reset electromagnet 46 having a reset magnetic core 47. The tripping electromagnet 44 is installed at an a end 34*a* of the control magnetic core 34, the reset electromagnet 46 is installed at a b end 34*b* of the control magnetic core 34, and the permanent magnet 42 is installed between the tripping electromagnet 44 and the reset electromagnet 46.

Under normal conditions, as shown in FIG. 4 and 5, the tripping magnetic core 45 of the tripping electromagnet 44 is affected by the permanent magnet 42. Therefore, the top 45*a* of the tripping magnetic core 45 always absorbs the a end (normally open end) 34*a* of the control magnetic core 34 to form a status of the b connection pin being closed and the a connection pin being opened.

Figure 6:
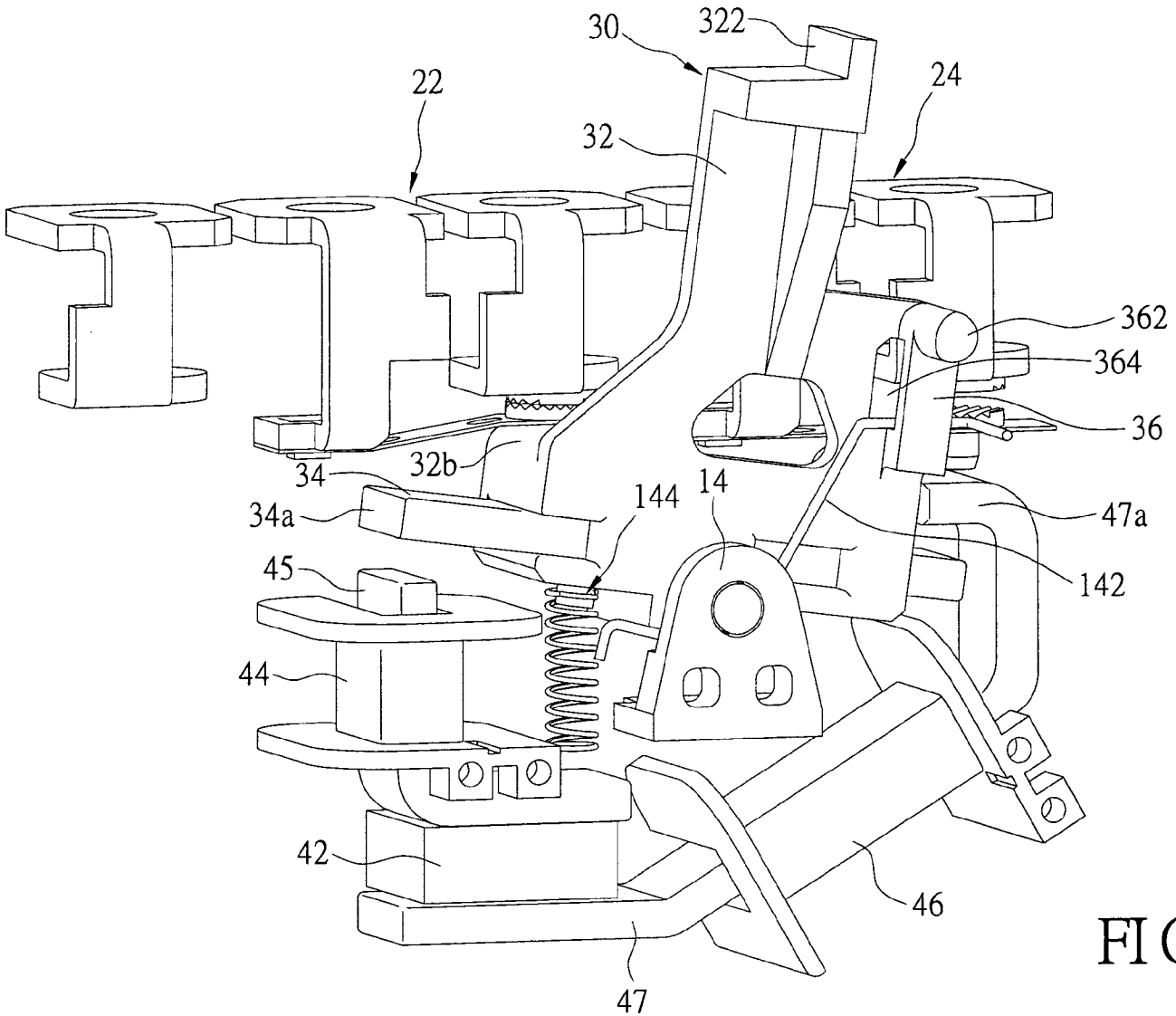
FIG. 6 is a perspective view of the inner mechanical structure of the electronic type protective relay when operating in the tripping status of the present invention.

When the circuit of the electronic device having the electronic type protective relay 1 detects an abnormal condition (for example an overload), the electronic circuit generates a tripping signal to generate a reverse magnetic force, as shown in FIG. 6. Then, the tripping spring 144 pushes and opens the a end 34*a* of the control magnetic core 34 (please also refer to FIG.4) to make the tripping rod 30 swing clockwise and make the normally closed connection pins 24 open. The pushing-top block 326 of the tripping rod 30 pushes upward to the normally open connection pins 22. Therefore, a status of the b connection pin being opened and the connection pin being closed is formed.

After a predetermined period has passed, the electronic device conducts the electricity to the reset electromagnet 46. By utilizing the reset magnetic core 47 in cooperation with the permanent magnet 42, the reset electromagnet 46 absorbs the b end 34*b* (normally closed end) of the control magnetic core 34 to make the tripping rod 30 reset to its original location as is shown in FIG. 4. Because the auto reset or the manual rest is allowed under some conditions, an operation device is necessary to achieve the different requirements. The characteristic of the electronic type protective relay of the present invention is the improvement of the operation device.

Figure 3:
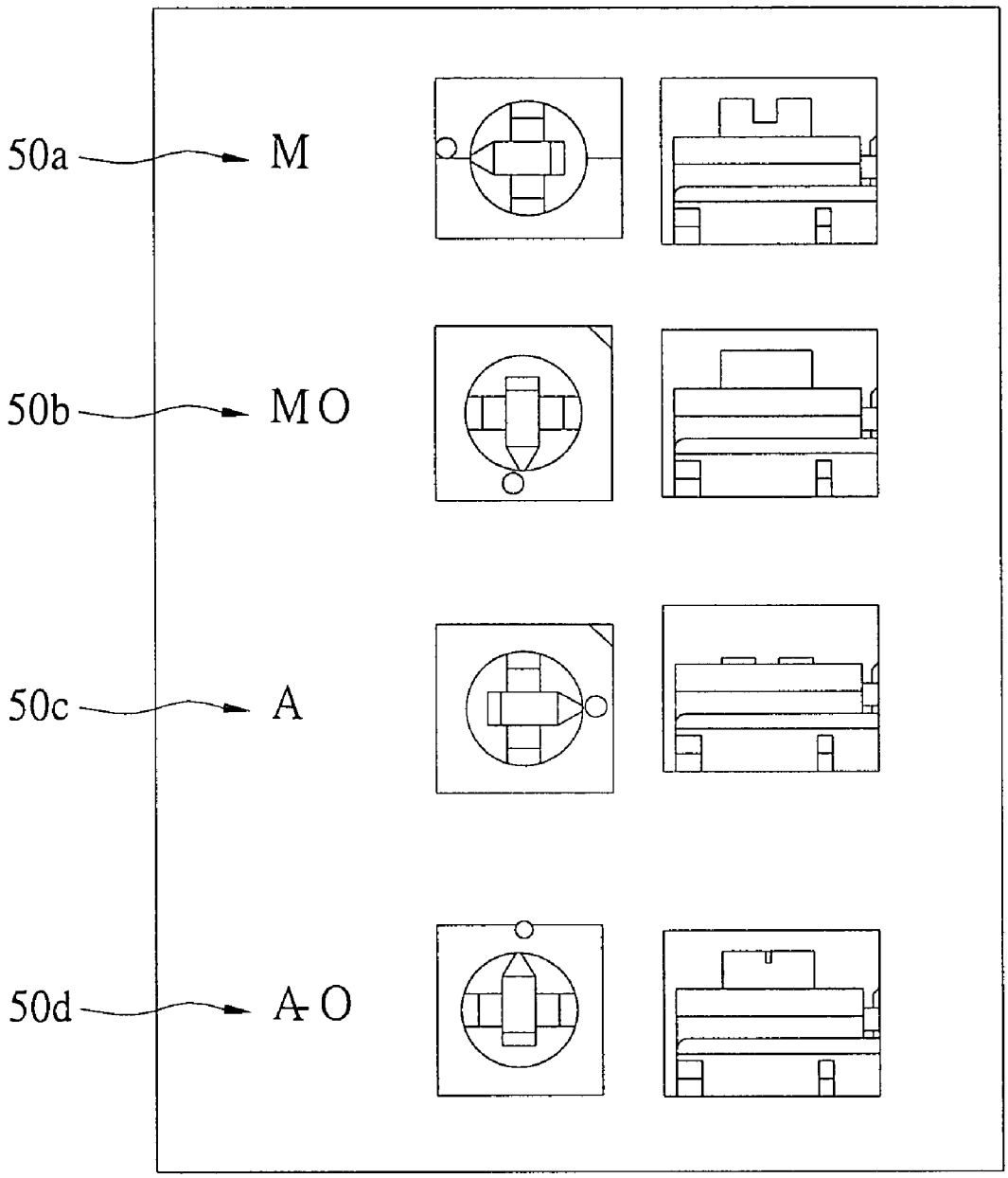
FIG. 3 is a schematic diagram of an operation status of the operation rod of the present invention.
Figure 7A:
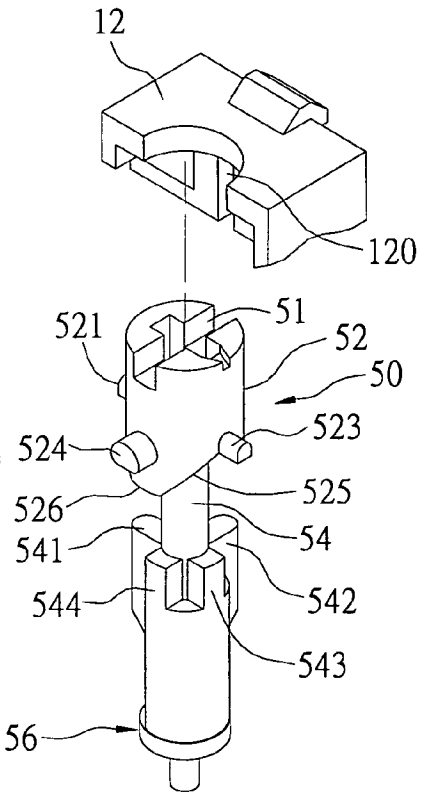
FIG. 7A is a perspective view of the operation rod of the electronic type protective relay of the present invention.
Figure 7:
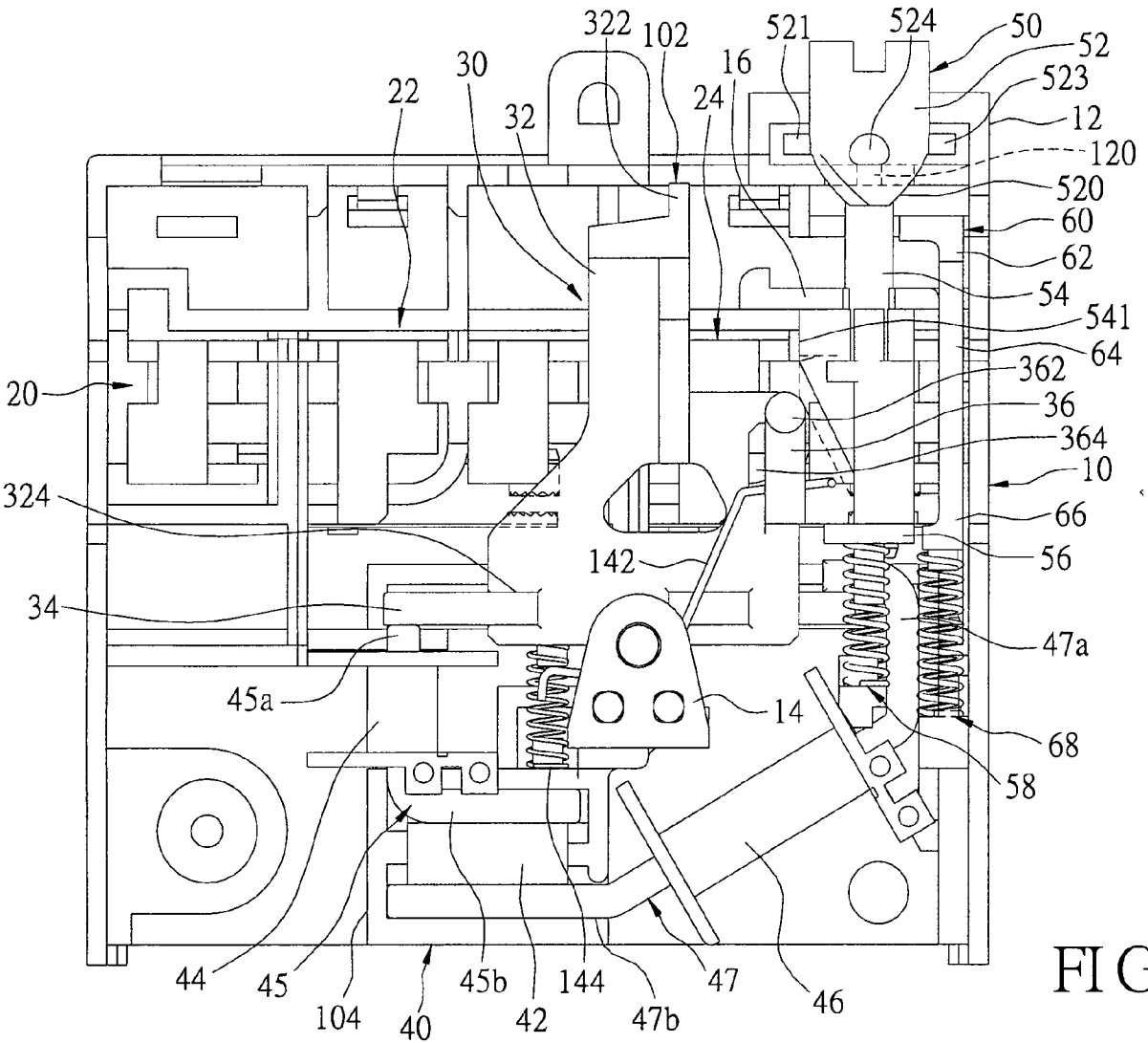
FIG. 7 is a front view of the inner mechanical structure of the electronic type protective relay of the present invention when operating in the M status.

Please refer to FIG. 7, which shows a front view of the inner mechanical structure of the electronic type protective relay of the present invention when operating in the M status. The operation device comprises the operation rod 50 and an auxiliary rod 60. The auxiliary rod 60 is installed in the insulating shell 10 and located on one side of the tripping rod 30. The operation rod 50 is installed between the tripping rod 30 and the auxiliary rod 60. The insulating shell 10 comprises a limiting flake 16 for restricting the movement of the operation rod 50 along a vertical direction and positioning the operation rod 50 in the vertical direction. The operation device further comprises a pair of elastic elements 58 and 68 for providing the spring force to the operation rod 50 and the auxiliary rod 60. The operation rod 50 is rotatably located at four locations (as shown in FIG. 3) and in corporation with the auxiliary rod 60 to stop or reset the circuit of the connection pins 22 and 24.

Please refer to FIG. 7A, which shows a perspective view of the operation rod of the electronic type protective relay of the present invention. The operation rod 50 comprises a rod head 52, a rod body 54, and a rod tail 56. The rod head 52 has an operation hole 51 located at the top of the rod head 52, a stop rod 524, three sliding rods 521, 522 and 523 that are identical and are vertical to each other protruding from the periphery, and a pair of convex blocks 526 that are formed at the bottom of the rod head 52 and are opposite to each other. A pair of concave slots 525 having an inverse-V shape is formed between the pair of convex blocks 526, respectively. The operation part 12 of the insulating shell 10 receives the rod head 52 of the operation rod 50. The operation part 12 has a positioning slot 120 to allow the sliding rods 521, 522 and 523 move along the vertical direction. The diameter of the stop rod 524 is larger than the width of the positioning slot 120. Therefore, the stop rod 524 cannot slide upward into the positioning slot 120 and the operation rod 50 is positioned in the operation part 12 by a head-covering method (50C status as is shown in FIG. 3).

The rod body 54 of the operation rod 50 has a pair of fan-shaped convex columns 543 and 544 protruding from the periphery of the rod body 54, and a pair of incline-pushing blocks 541 and 542 that are vertical to each other. The incline-pushing blocks 541, 542 correspond to the fan-shaped convex columns 543 and 544 and protrude from the periphery of the rod body 54.

Due to the different structures of the four angles located on the periphery of the operation rod 50 and the cooperation of the auxiliary rod 60, the electronic type protective relay 1 of the present invention can achieve the described four functions, including the M status 50*a*, the M-O status 50*b*, the A status 50*c*, and the A-O status 50*d*. The following descriptions illustrate the present invention in detail.

Please refer to FIGS. 7 and 7A. When the operation rod 50 is located at the first location—the M status 50*a*, the sliding rod 522 (which is covered) of the rod head 52 can move along the positioning slot 120 of the operation part 12. Therefore, the operation rod 50 is allowed to move up and down elastically. This means that operating the operation rod 50 manually is allowed. When the operation rod 50 is not pressed, the auxiliary rod 60 is in the concave slots 525 having an inverse-V shape. At this time, each of the convex blocks 526 of the rod head 52 departs from the auxiliary rod 60, and one end of the braking spring 142 is pressed downward to the braking part 36 to press the tripping rod 30. Thereby, the force from the reset electromagnet 46 is resisted so that the tripping rod 30 cannot not be reset automatically.

When an operator presses the operation rod 50 downward, the incline-pushing block 541 of the operation rod 50 pushes the braking column 362 of the braking part 36 downward from the side (as the inclining dash-line shown in the figure indicates). At this moment, the braking spring 142 departs from the bottom of the braking slot 364 of the braking part 36. The tripping rod 30 is therefore allowed 1to move and the magnet force absorbs the b end 34*b* of the control magnetic core 34. As a result, the tripping rod 30 swings counterclockwise to reset to conduct the pair of normally closed connection pins 24.

Figure 8A:
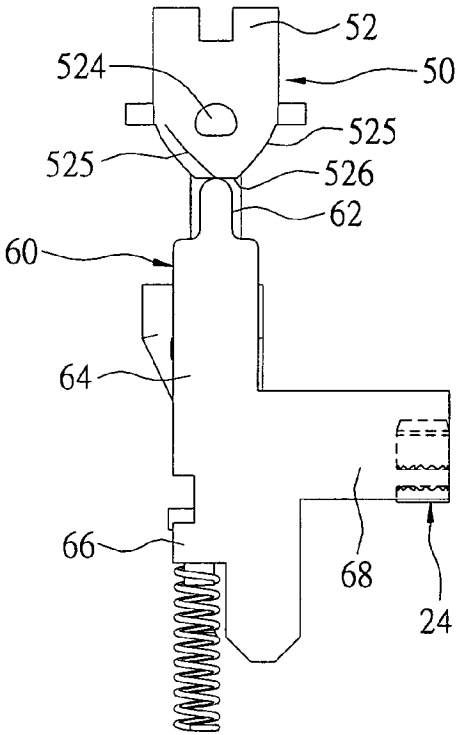
FIG. 8A is a side view of the auxiliary rod of the electronic type protective relay of the present invention.
Figure 8:
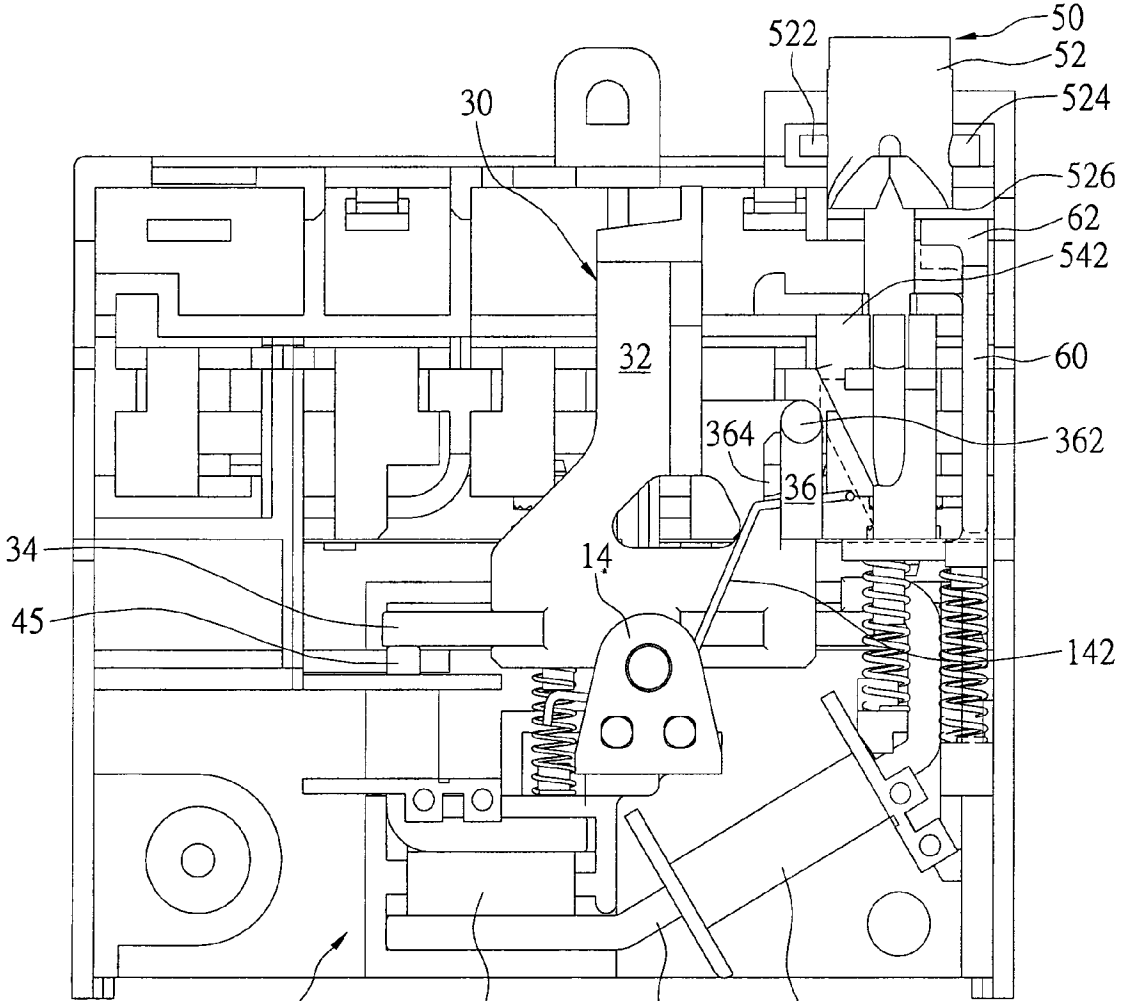
FIG. 8 is a font view of the inner mechanical structure of the electronic type protective relay when operating in the M-O status of the present invention.

Please refer to FIG. 8. The operation rod 50 is located at the second location—the M-O status 50*b*. The sliding rod 523 (which is covered) of the rod head 52 can move along the positioning slot 120 of the operation part 12. Therefore, the operation rod 50 is allowed to move up and down elastically. This means that operating the operation rod 50 manually is allowed. When the operation rod 50 is not pressed, one of the convex blocks 526 of the rod head 52 moves above the auxiliary rod 60, and one end of the braking spring 142 is pressed downward to the braking part 36 to press the tripping rod 30. Thereby, the tripping rod 30 cannot swing counterclockwise to its original location.

Please refer to FIG. 8A, which shows a side view of the auxiliary rod of the electronic type protective relay of the present invention. The auxiliary rod 60 comprises a rod head 62, a rod body 64, and a rod tail 66. A traverse rod 68 extends from the rod body 64, and the bottom of the traverse rod 68 pushes and connects the flexible flake under the pair of connection pins 24.

When an operator presses the operation rod 50 downward, the incline-pushing block 542 of the operation rod 50 pushes the braking part 36 of the tripping rod 30 from the side (as the inclining dash-line shown in the figure indicates). The braking spring 142 thus departs from the bottom of the braking slot 364 of the braking part 36 to allow the tripping rod 30 to move. At the same time, the convex block 526 pushes the auxiliary rod 60. The tripping rod 30 therefore swings counterclockwise and resets on the one hand, while on the other hand the traverse rod 68 of the auxiliary rod 60 pushes downward and opens the normally closed connection pins 24 to make the circuit open. Thereby, the manual reset and stop function is achieved.

Figure 9:
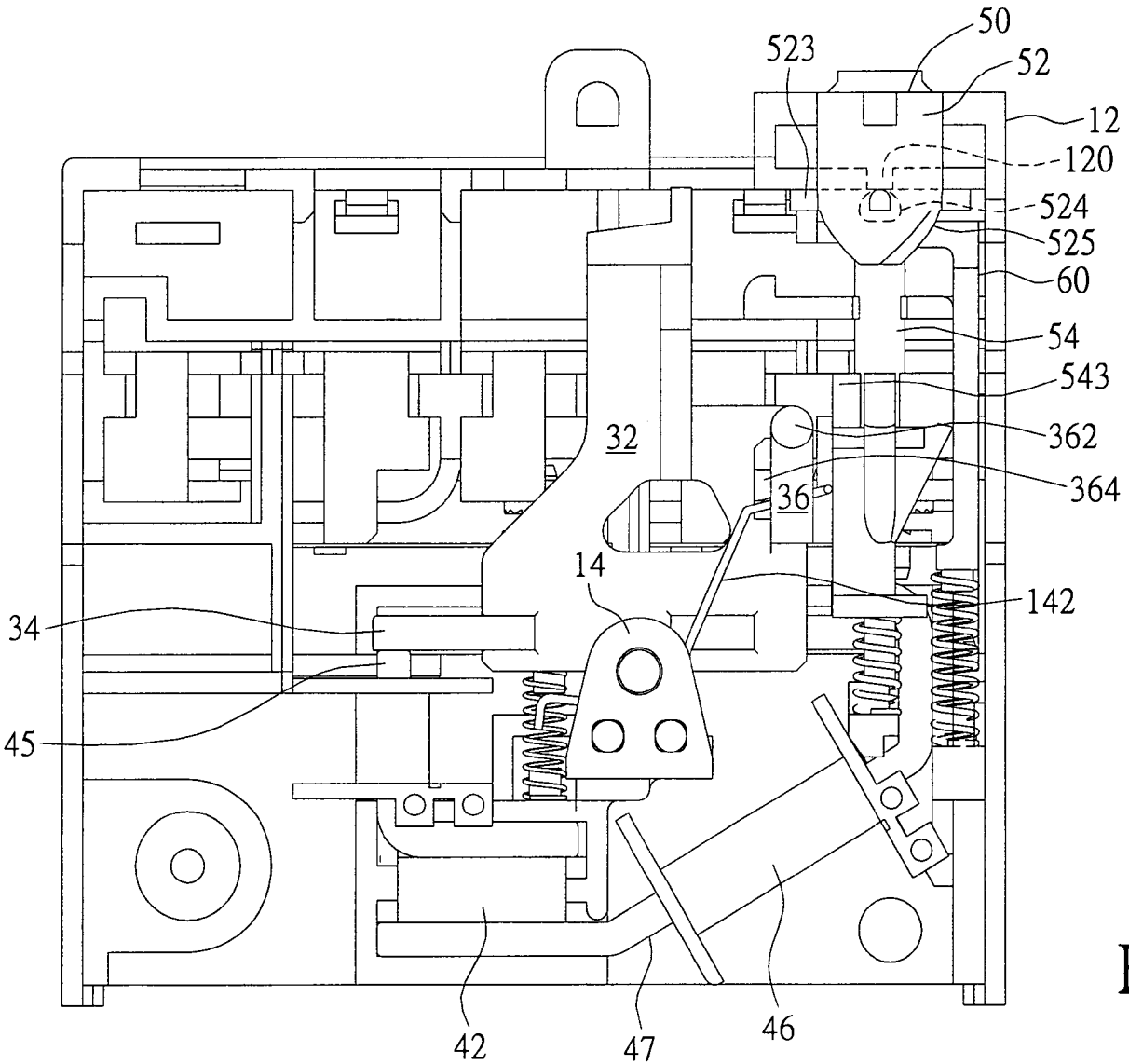
FIG. 9 is a font view of the inner mechanical structure of the electronic type protective relay when operating in the A status of the present invention.

Please refer to FIG. 9. The operation rod 50 is located at the third location—the A status 50*c*. The stop rod 524 of the rod head 52 is wedged at the bottom of the positioning slot 120 of the operation part 12 and is positioned in the operation part 12 by a head-covering method. Therefore, the operation rod 50 is not allowed to move up. This means that the testing operation achieved by pressing the operation rod 50 downward to stop is not allowed. At this moment, the top of the auxiliary rod 60 is located in the concave slot 525 of the rod head 52. This means that the operation rod 50 does/can not press the auxiliary rod 60 downward, and the fan-shaped convex column 543 of the operation rod 50 pushes the braking spring 142 from the side to make the braking spring 142 depart from the braking slot 364 of the tripping rod 30. As a result, the tripping rod 30 is allowed to be absorbed by the magnetic force and swing counterclockwise. When the reset electromagnet 46 is conducted, the tripping rod 30 automatically resets to conduct the normally closed connection pins 24. Thereby, the auto reset and non-stop function is achieved.

Figure 10:
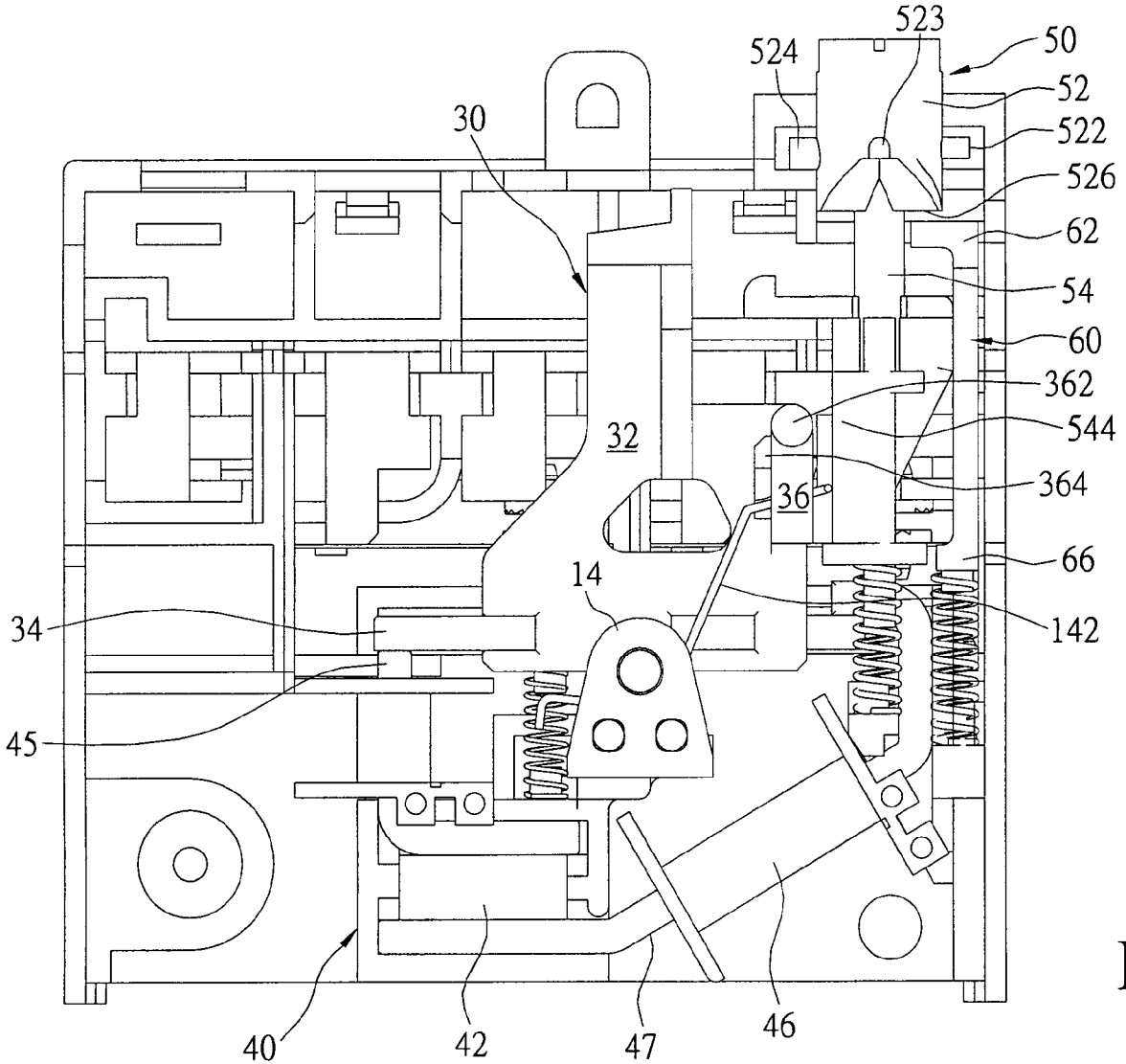
FIG. 10 is a font view of the inner mechanical structure of the electronic type protective relay when operating in the A-O status of the present invention.

Please refer to FIG. 10. The operation rod 50 is located at the fourth location—the A-O status 50*d*. The sliding rod 521 (which is covered) of the rod head 52 can move along the positioning slot 120 of the operation part 12. Therefore, the operation rod 50 is allowed to move up and down elastically. This means that the testing operation of pressing the operation rod 50 downward manually to stop is allowed. When the operation rod 50 is not pressed, one of the convex blocks 526 of the rod head 52 moves above the auxiliary rod 60, and the fan-shaped convex column 544 pushes the braking spring 142 from the side to make the braking spring 142 depart from the braking slot 364 of the tripping rod 30. Thereby, the tripping rod 30 is allowed to swing counterclockwise.

When the reset electromagnet 46 is conducted, on the one hand the tripping rod 30 can automatically reset to conduct the normally closed connection pins 24. On the other hand, the convex block 526 of the rod head 52 pushes the auxiliary rod 60 downward, and the traverse rod 68 of the auxiliary rod 60 pushes and opens the pair of normally closed connection pins 24 to make the circuit open, when the operation rod 50 is pressed downward. As a result, the stop function is achieved. Thereby, the auto reset and stop function is achieved.

The present invention has the following characteristics:

1. The electronic type protective relay of the present invention integrates the operation interface of the mechanical structure into a single operation rod. The operation panel is thus simple and neat. It reduces the number of components and simplifies the assembling procedure.

2. In the electronic type protective relay of the present invention, the operation rod achieves four functions, including the manual reset and stop function, the manual reset and non-stop function (in which the b connection cannot be opened manually), the auto reset and non-stop function (in which the b connection cannot be opened manually), and the auto reset and stop function.

3. In the electronic type protective relay of the present invention, the a end and b end of the control magnetic core is respectively absorbed due to the collaboration of the permanent magnet and the tripping electromagnet and the permanent magnet and the resetting electromagnet. Different functions are thus achieved without complex design and closed magnetic loop.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. An electronic type protective relay, comprising:

an insulating shell having a pair of normally open connection pins and a pair of normally closed connection pins;

a braking spring;

a tripping rod elastically pivoted in the inner part of the insulating shell and selectively conducting the two pairs of connection pins, the tripping rod comprising a control magnetic core, and a braking part installed on one side of the tripping rod for receiving one end of the braking spring;

a magnetic-force device comprising a tripping electromagnet installed at one end of the control magnetic core, a reset electromagnet installed at another end of the control magnetic core, and a permanent magnet installed between the tripping electromagnet and the reset electromagnet; and an operation device comprising an auxiliary rod installed in the insulating shell and located on one side of the tripping rod, and an operation rod installed between the tripping rod and the auxiliary rod;

wherein the operation rod is rotatably set at four locations and in cooperation with the auxiliary rod to stop or reset the circuit of the two pairs of connection pins.

2. The electronic type protective relay as claimed in claim 1, wherein the insulating shell comprises a pivoting base, at least one pivoting rod protrudes from the bottom of the tripping rod for pivoting with the pivoting base, and the electronic type protective relay has a tripping spring used for providing the tripping force of the tripping rod.

3. The electronic type protective relay as claimed in claim 1, wherein the operation rod protrudes beyond the insulating shell.

4. The electronic type protective relay as claimed in claim 1, wherein the braking part comprises a braking slot and a braking column, and the braking spring extends into the braking slot.

5. The electronic type protective relay as claimed in claim 4, wherein the operation rod selectively contacts and pushes the braking column or pushes the braking spring.

6. The electronic type protective relay as claimed in claim 1, wherein the operation rod comprises a rod head, the rod head comprises an operation hole formed at the top of the rod head, a pair of convex blocks formed at the bottom of the rod head and opposite to each other, a stop rod, and three sliding rods being vertical to each other and protruding from the periphery.

7. The electronic type protective relay as claimed in claim 6, wherein the insulating shell comprises an operation part for receiving the rod head of the operation rod, the operation part comprises a positioning slot to make the sliding rod move in a vertical direction, and a diameter of the stop rod is larger than a width of the positioning slot.

8. The electronic type protective relay as claimed in claim 7, wherein the operation rod comprises a rod body connected with the rod head, the rod body comprises a pair of fan-shaped convex columns protruding from the periphery of the rod body, and a pair of incline-pushing blocks being vertical to each other that correspond to the fan-shaped convex columns and protrudes from the periphery of the rod body.

9. The electronic type protective relay as claimed in claim 8, wherein when the operation rod is located at a first location, the rod head movably locates in the operation part and the convex blocks of the rod head depart from the auxiliary rod, and the braking spring presses the tripping rod; when the operation rod is pressed downward, one of the incline-pushing blocks pushes the tripping rod to make the tripping rod reset to conduct the pair of normally closed connection pins.

10. The electronic type protective relay as claimed in claim 8, wherein when the operation rod is located at a second location, the rod head movably locates in the operation part and one of the convex blocks of the rod head locates above the auxiliary rod, and the braking spring presses the tripping rod; when the operation rod is pressed downward, one of the incline-pushing blocks pushes the tripping rod and one of the convex blocks pushes the auxiliary rod, and the auxiliary rod pushes and opens the pair of normally closed connection pins to make the circuit open.

11. The electronic type protective relay as claimed in claim 8, wherein when the operation rod is located at a third location, the rod head is positioned in the operation part and the convex blocks of the rod head depart from the auxiliary rod, and one of the fan-shaped convex columns pushes the braking spring to make the braking spring depart from the tripping rod; when the reset electromagnet conducts, the tripping rod is reset to conduct the pair of normally closed connection pins.

12. The electronic type protective relay as claimed in claim 8, wherein when the operation rod is located at a fourth location, the rod head movably locates in the operation part and one of the convex blocks of the rod head locates above the auxiliary rod, and one of the fan-shaped convex columns pushes the braking spring to make the braking spring depart from the tripping rod, when the reset electromagnet conducts, the tripping rod is reset to conduct the pair of normally closed connection pins; when the operation rod is pressed downward, one of the convex blocks pushes the auxiliary rod and the auxiliary rod pushes and opens the pair of normally closed connection pins to make the circuit open.

13. The electronic type protective relay as claimed in claim 1, wherein the insulating shell comprises a limiting flake for restricting the operation rod to move along a vertical direction.

14. An electronic type protective relay, comprising:

an insulating shell having a pair of normally open connection pins and a pair of normally closed connection pins;

a braking spring, the braking spring being pivoted within the insulating shell;

a tripping rod elastically pivoted in the inner part of the insulating shell and selectively conducting the two pairs of connection pins, the tripping rod comprising a control magnetic core, a braking column and a braking slot located on one side of the tripping rod, and one end of the braking spring extending into the braking slot;

a magnetic-force device comprising a tripping electromagnet installed at one end of the control magnetic core, a reset electromagnet installed at another end of the control magnetic core, and a permanent magnet installed between the tripping electromagnet and the reset electromagnet; and an operation device comprising an auxiliary rod installed in the insulating shell and located on one side of the tripping rod, and an operation rod installed between the tripping rod and the auxiliary rod;

wherein the operation rod selectively contacts and pushes the braking column or pushes the braking spring, thereby the operation rod rotatably locates at a first, a second, a third, and a fourth location and cooperates with the auxiliary rod to provide four operation modes to the circuit of the two pairs of connection pins, comprising a manual reset and stop function, a manual reset and non-stop function, an auto reset and non-stop function, and an auto reset and stop function.

15. The electronic type protective relay as claimed in claim 14, wherein the insulating shell comprises a pivoting base and at least one pivoting rod protruding from the bottom of the tripping rod for pivoting with the pivoting base, and the electronic type protective relay has a tripping spring used for providing the tripping force of the tripping rod.

16. The electronic type protective relay as claimed in claim 14, wherein the operation rod protrudes beyond the insulating shell.

17. The electronic type protective relay as claimed in claim 14, wherein the braking slot is formed below the braking column.

18. The electronic type protective relay as claimed in claim 14, wherein the operation rod comprises a rod head, the rod head comprises an operation hole formed at the top of the rod head, a pair of convex blocks formed at the bottom of the rod head and opposite to each other, a stop rod, and three sliding rods being vertical to each other and protruding from the periphery.

19. The electronic type protective relay as claimed in claim 18, wherein the insulating shell comprises an operation part for receiving the rod head, the operation part comprises a positioning slot to make the sliding rod move in a vertical direction, and a diameter of the stop rod is larger than a width of the positioning slot.

20. The electronic type protective relay as claimed in claim 19, wherein the operation rod comprises a rod body connected with the rod head, the rod body comprises a pair of fan-shaped convex columns protruding from the periphery of the rod body, and a pair of incline-pushing blocks being vertical to each other that correspond to the fan-shaped convex columns and protrudes from the periphery of the rod body.

21. The electronic type protective relay as claimed in claim 20, wherein when the operation rod is located at the first location, the rod head movably locates in the operation part and the convex blocks depart from the auxiliary rod, and the braking spring presses the tripping rod; when the operation rod is pressed downward, one of the incline-pushing blocks pushes the tripping rod to make the tripping rod reset to conduct the pair of normally closed connection pins.

22. The electronic type protective relay as claimed in claim 20, wherein when the operation rod is located at the second location, the rod head movably locates in the operation part and one of the convex blocks locates above the auxiliary rod, and the braking spring presses the tripping rod; when the operation rod is pressed downward, one of the incline-pushing blocks pushes the tripping rod and one of the convex blocks pushes the auxiliary rod, and the auxiliary rod pushes and opens the pair of normally closed connection pins to make the circuit open.

23. The electronic type protective relay as claimed in claim 20, wherein when the operation rod is located at the third location, the rod head is positioned in the operation part and the convex blocks depart from the auxiliary rod, and one of the fan-shaped convex columns pushes the braking spring to make the braking spring depart from the tripping rod; when the reset electromagnet conducts, the tripping rod is reset to conduct the pair of normally closed connection pins.

24. The electronic type protective relay as claimed in claim 20, wherein when the operation rod is located at the fourth location, the rod head movably locates in the operation part and one of the convex blocks locates above the auxiliary rod, and one of the fan-shaped convex columns pushes the braking spring to make the braking spring depart from the tripping rod, when the reset electromagnet conducts, the tripping rod is reset to conduct the pair of normally closed connection pins; when the operation rod is pressed downward, one of the convex blocks pushes the auxiliary rod and the auxiliary rod pushes and opens the pair of normally closed connection pins to make the circuit open.

* * * * *